US011975254B2

(12) United States Patent
Paul et al.

(10) Patent No.: US 11,975,254 B2
(45) Date of Patent: May 7, 2024

(54) REMOVABLE ACCESSORY FOR A FENCING MASK

(71) Applicant: Leon Paul Equipment Company Limited, London (GB)

(72) Inventors: Benjamin Paul, London (GB); Jacek Bujko, Szczecin (PL)

(73) Assignee: Leon Paul Equipment Company Limited, London (GB)

( * ) Notice: Subject to any disclaimer, the term of this patent is extended or adjusted under 35 U.S.C. 154(b) by 206 days.

(21) Appl. No.: 17/624,937

(22) PCT Filed: May 6, 2020

(86) PCT No.: PCT/GB2020/051109
§ 371 (c)(1),
(2) Date: Jan. 5, 2022

(87) PCT Pub. No.: WO2021/005324
PCT Pub. Date: Jan. 14, 2021

(65) Prior Publication Data

US 2022/0266114 A1 Aug. 25, 2022

(30) Foreign Application Priority Data

Jul. 5, 2019 (GB) ..... 1909702

(51) Int. Cl.
*A63B 69/02* (2006.01)
*A41D 13/11* (2006.01)
*A63B 71/10* (2006.01)

(52) U.S. Cl.
CPC ..... *A63B 69/02* (2013.01); *A63B 71/10* (2013.01); *A41D 13/11* (2013.01);
(Continued)

(58) Field of Classification Search
CPC ..... A63B 69/02; A63B 71/10; A63B 71/0036; A63B 2071/105; A63B 2209/08;
(Continued)

(56) References Cited

U.S. PATENT DOCUMENTS 4,163,817 A * 8/1979 DiCarlantonio ..... E06B 9/52 428/33
2019/0001214 A1* 1/2019 Burke ..... A63B 69/02

FOREIGN PATENT DOCUMENTS

FR 2784591 A1 * 4/2000 ..... A63B 71/10
FR 2784591 A1 4/2000
(Continued)

OTHER PUBLICATIONS

Hiromasa Tamura, Protector for Face Mask, Oct. 13, 2005; EPO English Machine Translation; pp. 1-7 (Year: 2005).*
(Continued)

*Primary Examiner* — Bayan Salone
(74) *Attorney, Agent, or Firm* — Skaar Ulbrich Macari, P.A.

(57) ABSTRACT

A removable accessory for a fencing mask provided with a mesh having an array of apertures is provided. The accessory can include a main body having a first surface, and a plurality of projections extending from the first surface of the main body. Each projection is configured to be removably insertable into an aperture of the mesh. Therefore, the accessory may be removably attached to the fencing mask, without damaging the fencing mask.

16 Claims, 8 Drawing Sheets

(52) U.S. Cl.
CPC ..... *A63B 2071/105* (2013.01); *A63B 2209/08* (2013.01); *A63B 2209/10* (2013.01); *A63B 2220/806* (2013.01); *A63B 2220/807* (2013.01); *A63B 2225/685* (2013.01); *A63B 2225/74* (2020.08)

(58) Field of Classification Search
CPC ..... A63B 2209/10; A63B 2220/806; A63B 2220/807; A63B 2225/685; A63B 2225/68; A63B 2225/74; A41D 13/11
See application file for complete search history.

(56) References Cited

FOREIGN PATENT DOCUMENTS

| | | | | | |
|---|---|---|---|---|---|
| JP | S61148371 | U | * | 9/1986 | |
| JP | S61148371 | U | | 9/1986 | |
| JP | 2005278890 | A | * | 10/2005 | ..... A63B 71/10 |
| JP | 2005278890 | A | | 10/2005 | |
| JP | 2012170530 | A | * | 9/2012 | |
| JP | 2012170530 | A | | 9/2012 | |

OTHER PUBLICATIONS

Chauveau Pierre Henri Luc; Device for use in training by fencing master and pupil; Apr. 21, 2000; EPO English Machine Translation; p. 1 (Year: 2000).*
International Search Report rendered by the International Searching Authority for PCT/GB2020/051109, dated Aug. 6, 2020, 4 pages.
Written Opinion rendered by the International Searching Authority for PCT/GB2020/051109, dated Aug. 6, 2020, 7 pages.

* cited by examiner

REMOVABLE ACCESSORY FOR A FENCING MASK

PRIORITY

This application claims the priority of Great Britain patent application GB 1909702.1, filed Jul. 5, 2019, which is hereby incorporated herein by reference in its entirety.

FIELD OF THE INVENTION

The present invention relates to fencing equipment and in particular to an accessory for a fencing mask.

BACKGROUND OF THE INVENTION

The modern sport of sword fencing requires the use of protective clothing, including a protective face mask that is typically made from a stainless steel mesh.

It can be beneficial to attach components or accessories to the fencing mask from time to time. For example, protective bibs, padding, cameras and lights may be attached to the fencing mask.

It is preferable that these additional components or accessories can be temporarily attached to the fencing mask, such that they may easily be repositioned, removed or replaced.

For example, it may be desirable to provide the fencing mask with a removable padding that may be attached to the interior of the fencing mask. Using removable padding allows the user to customise the fencing mask, by applying padding of different thicknesses. Providing removable padding also assists with the cleaning of the fencing mask.

Additionally, recently introduced regulations now require that lighting be attached inside the fencing mask for certain events, to indicate to spectators when hits have been scored. This requires such lighting to be attached and removed for different major events.

It is also desirable to be able to position the lights, padding or other accessories in different positions on the fencing mask, depending on the shape of the user's head.

Typically, accessories such as padding, cameras, lights and bibs are attached to the fencing mask using hook and loop fastening systems. These systems require one portion of the hook and loop fastener to be permanently attached to the inside of the fencing mask, for example using glue or rivets.

However, over time, the hook and loop fastener can become worn through use and may need replacing. Using glue or rivets makes it difficult to remove the hook and loop fastener from the inside of the fencing mask. Attempts to remove and replace the hook and loop fastener can cause damage to the inside of the fencing mask and/or to the accessory.

Therefore, users often do not replace the hook and loop fasteners, which can make the fencing mask unsafe or cause the user to dispose of the fencing mask prematurely.

Additionally, such accessories can typically only be attached to the fencing mask at the specific position where the hook and loop fastener has been attached. Therefore, the customisability of the fencing mask is generally limited by the position of the hook and loop fasteners on the fencing mask.

Therefore, there is a need for a fencing accessory that can be temporarily attached to a fencing mask, and removed without damaging the fencing mask. There is also a need for a fencing accessory that can be attached to a fencing mask in a range of positions.

SUMMARY OF THE INVENTION

In view of the limitations of the current known solutions, the present invention seeks to provide a removable accessory for a fencing mask, and a method of removably attaching an accessory to a fencing mask.

To this end, the present invention provides a removable accessory for a fencing mask according to certain embodiments.

The accessory of the present invention may be removably attached to a fencing mask provided with a mesh having an array of apertures.

Typically, a mesh is an array of woven wires that defines a plurality of apertures. Therefore, the array of apertures is generally formed by the spaces between the woven wires.

The aperture spacing of the mesh is defined as the distance between the centres of adjacent apertures.

The protective face masks used in fencing are typically made from mesh having a standardised wire diameter and aperture size. Therefore, the aperture spacing of the mesh is standardised for fencing masks.

For example, some fencing masks have meshes with a maximum aperture spacing of approximately 2.1 mm. The wires of the mesh may be round stainless steel wire CrNi 18-10, and may have a minimum gauge of 1 mm diameter. The apertures defined by the wires may be square, with an opening of approximately 1.9 mm.

With that said, it is appreciated that the accessory of the present invention could also be used with meshes having any suitable wire diameter and aperture spacing. It is appreciated that the accessory of the present invention could also be used with other mesh constructions, provided that they have an array of apertures.

The accessory of the present invention comprises a main body having a first surface, and a plurality of projections extending from the first surface of the main body.

Each projection is configured to be removably insertable into an aperture of the mesh.

In this way, the present invention allows the accessory to be removably attached to the fencing mask, without the need for additional attachment means, for example hook and loop fasteners.

Since the accessory of the present invention makes use of the existing apertures in the mesh of the fencing mask, the accessory may be temporarily attached to the mesh without causing damage to the fencing mask.

Additionally, since the apertures of fencing masks are standardised in size, the accessory may be repositioned at different positions on the fencing mask, or indeed on different fencing masks.

It is envisioned that the accessory of the present invention could be configured to be attachable to the mesh either on the inside of the fencing mask or the outside of the fencing mask, depending on the function of the component that is to be attached to the mask. For example, it may be desirable that padding is removably attachable to the inside of the fencing mask.

Preferably, the main body may be thin (i.e. have a low profile). If the accessory is attachable to the inside of the fencing mask, then it may be particularly desirable that the main body is thin, so that the accessory sits substantially flush with the fencing mask and does not project too close to the user's face.

Preferably, the main body may be manufactured from a flexible material, such that the accessory may accommodate various curvatures of the mesh (e.g. depending on the position of the mesh on the fencing mask).

The projections may be integral with main body of the accessory. Alternatively, the projections may be manufactured separately to the main body of the accessory.

Preferably, the cross-section of each projection may be greater than or equal to the size of each aperture. Further preferably, each projection may be configured to be compressible upon insertion into the aperture.

Since the wires of the mesh are typically round, the cross-sectional area of each aperture of the mesh is generally at a minimum at the centre of the mesh.

The length of at least one projection may be greater than half of the diameter of each wire of the mesh. In this way, the projection may extend far enough into the mesh to pass through the smallest point of the aperture (i.e. the pinch point).

It will be appreciated that the frictional contact between the projections and the wires of the mesh helps to secure the accessory to the fencing mask.

Additionally or alternatively, the portion of the projection that extends beyond the smallest point of the aperture (the pinch point) could provide a mechanical attachment with the fencing mask, since the small size of the aperture at its centre could restrict the ability of the tip of the projection to readily pass back through the aperture.

The length of at least one projection may be greater than the diameter of each wire of the mesh. In this way, the projection may extend beyond the surface of the mesh, to ensure that the accessory is securely attached.

Alternatively, it may be beneficial that the projections do not extend beyond the surface of the mesh, so that the surface of the mesh remains smooth when the accessory is attached to the fencing mask.

Alternatively, the cross-section of each projection may be smaller than the size of each aperture, and the accessory may be secured to the mesh in another way. For example, at least one projection could be provided with a tip that engages with at least one wire of the mesh, in order to secure the accessory to the fencing mask. Additionally or alternatively, at least two projections may be angled relative to one another in order to secure the accessory.

Preferably, the distance between at least two of the projections may be a multiple of the aperture spacing. In other words, the distance between at least two of the projections may be a multiple of the distance between two adjacent apertures.

In this way, the accessory may be attachable to the fencing mask using two apertures on the same row or column of the mesh.

It is envisioned that the distance between at least two of the projections may be any suitable multiple of the spacing of the apertures in the array of the mesh.

It is appreciated that the distance between the projections may be dependent on the size or weight of the accessory. That is to say, the connection points formed by the projections may advantageously be distributed so as to spread the attachment load on the mesh.

It is also envisioned that the distance between the projections does not need to be a multiple of the aperture spacing, for example if the projections are configured to be insertable into apertures in a different row and column of the mesh. That is to say, the projections could be positioned such that the accessory is attachable to the fencing mask at a diagonal orientation, relative to the fencing mask when in use.

Essentially, any projection spacing is envisaged provided that the inter-projection spacing facilitates the insertion of the projections into different apertures of the mesh.

Preferably, at least two projections may be configured to be insertable into adjacent apertures of the mesh. For example, projections may be provided in clusters of two or more projections that are configured to be insertable into adjacent apertures of the mesh. That is to say, the distance between the projections in a cluster may be equal to the aperture spacing.

In other words, two projections in a cluster may be configured to be insertable into apertures on either side of one wire of the mesh.

In this way, the projections may be configured to exert a force on either side of the wire, such that the wire is gripped by the projections. For example, the distance between the projections may be such that the projections grip the wire, or the projections may be angled so as to grip the wire.

Therefore, providing two projections that are insertable into adjacent apertures of the mesh may improve the strength of the attachment between the accessory and the fencing mask.

The accessory may comprise any suitable number and arrangement of projections extending from the main surface. For example, the accessory may comprise either two projections, four projections or eight projections.

The plurality of projections may be separated into at least two clusters or groups, wherein the distance between at least one projection of each cluster is a multiple of the aperture spacing. Providing the accessory with projections separated into a plurality of clusters may help to secure the accessory on the fencing mask, particularly if the accessory is large or heavy.

As noted above, each cluster may comprise at least two projections that are configured to be insertable into adjacent apertures of the mesh. In this way, the pairs of projections may grip the mesh, in the manner described above.

Preferably, at least one of the projections may extend perpendicular to the first surface. In this way, the perpendicular projections may be inserted into the mesh simply by pushing on the main body, thereby making the accessory easier to attach to the fencing mask.

Additionally or alternatively, at least one of the projections may extend from the first surface at an angle offset from the perpendicular. In other words, at least one of the projections may extend from the first surface at an angle between 0° and 90° to the first surface.

Preferably, at least two projections may extend substantially parallel to one another. For example, the projections may extend perpendicular to the first surface, or at the same angle offset from the perpendicular. In this way, the accessory may be easy to attach to the fencing mask, as the parallel projections may be inserted into the apertures of the mesh without being tilted relative to one another.

Alternatively, at least two projections may extend from the first surface at a different angle to one another. For example, a first projection may extend perpendicular to the first surface and a second projection may extend from the first surface at an angle offset from the perpendicular. Additionally or alternatively, at least two projections may extend from the first surface at different angles that are offset from the perpendicular.

In this way, at least one of the projections may be tilted relative to another projection, in order to insert the projections into the mesh. For example, the main body of the accessory may be flexible to allow the projections to be tilted relative to one another. Additionally or alternatively, at least one projection may be flexible.

When inserted into the mesh, the tilted projection may exert a force on the wires of the mesh when attempting to return to its original position, thereby helping to retain the accessory on the fencing mask.

Preferably, at least one of the projections may comprise a tip at the distal end thereof, wherein the tip has a larger cross-section than the rest of the projection.

Further preferably, the cross-section of the tip may be greater than or equal to the size of the aperture.

If the cross-section of the tip is greater than or equal to the size of the aperture, the frictional contact between the tip and the wires of the mesh help to secure the accessory to the fencing mask.

Additionally or alternatively, the tip could provide a mechanical attachment with the fencing mask. For example, the small size of the aperture at its centre could restrict the ability of the tip to pass back through the aperture.

Therefore, providing the projections with a tip having a cross-section that is greater than or equal to the minimum size of the aperture may help to secure the accessory on the fencing mask and prevent it from readily slipping out of the mesh.

Preferably, the tip may be configured to be compressible when inserted into the aperture.

The tip may be configured such that it is compressed when it passes through the smallest point, i.e. the pinch point, of the aperture, and expands when it passes beyond the centre of the mesh.

Having a tip that is compressible may be beneficial, as the compressible tip may help to secure the projection in the aperture. That is, the tip may expand back to its original size when the tip passes beyond the centre of the mesh, thereby restricting the ability of the tip to pass back through the aperture.

The compressibility of the tip could be achieved by manufacturing the tip from a compressible material.

However, it is also envisioned that the tip could instead comprise a rigid material. The compressibility of the tip could be achieved by other means, for example by providing the tip with slots and/or internal voids. These features could allow the tip to compress as it passes through the aperture's minimum size (i.e. the pinch point).

Alternatively, the cross-section of at least one tip may be smaller than the size of the aperture. The tip of the projection may be shaped to secure the accessory to the fencing mask. For example, the tip could be provided with a hook that engages with the wires of the mesh to secure the accessory.

Preferably, at least one of the projections may be shaped to complement the shape of the wire of the fencing mask. For example, at least one of the projections may include a recessed portion, which is shaped to complement the wire. In particular, for a wire having a circular cross-section, each of the projections may be provided with a cylindrical recessed portion.

As explained above, fencing masks are typically made from mesh having a standardised wire diameter. Therefore, the recessed portion may be shaped to complement a wire having the standard diameter.

The complementary shaping may increase the contact area between the projections and the wire of the fencing mask, when the accessory is attached to the fencing mask. In this way, the frictional contact between the accessory and the fencing mask is increased, thereby improving the security of the attachment between the accessory and the fencing mask.

Preferably, at least two projections comprising recessed portions may be configured to be insertable into adjacent apertures of the mesh. For example, projections may be provided in clusters of two or more projections that are configured to be insertable into adjacent apertures of the mesh. That is to say, the distance between the projections in a cluster may be equal to the aperture spacing.

Therefore, when the accessory is attached to the fencing mask, two recessed portions may contact either side of a single wire of the mesh.

In this way, frictional contact between the projections and the wire is further increased, to improve the grip of the accessory on the fencing mask.

Preferably, the distal end of the projections may be angled, to facilitate easy insertion of the projections in the apertures of the mesh. In other words, the cross-sectional area of the projections may decrease towards the distal end of the projections.

Preferably, at least one attachment means may be provided on a second surface of the main body.

Further preferably, the second surface may be opposite the first surface, such that the attachment means faces away from the mesh when the accessory is attached to the fencing mask.

The attachment means may be used to removably attach any suitable component to the fencing mask. For example, the attachment means may be used to attach a light, padding, a camera or a protective bib to the fencing mask.

The attachment means may allow different components to be interchangeably attached to the same accessory. For example, the accessory may be used to attach a light to the fencing mask, and may later be used to attach a camera to the fencing mask.

The attachment means may be any suitable means of attaching a component to the accessory. For example, the attachment means may comprise one portion of a hook and loop fastener, with the corresponding portion being provided on the component. Alternatively, the attachment means may comprise a clip that engages with the component.

Preferably, the main body of the accessory may have a two-part construction. That is, the main body may comprise a first part and a second part that are engageable with one another to form the main body.

Preferably, the first part may comprise a plug part and the second part may comprise a corresponding socket part. The plug part and the socket part may be cooperatively shaped, such that they are engageable with one another.

For example, the plug part may comprise at least one rod, which is receivable in at least one corresponding aperture in the socket part. It is envisioned providing the plug part with a plurality of rods and the socket part with a plurality of apertures could assist with the alignment of the socket part with the plug part.

Additionally or alternatively, the rod and aperture could each include at least one corner, to improve the alignment of the socket part with the plug part. However, it is also envisioned that the plug part could comprise a single circular rod, and the socket part could comprise a single circular aperture, particularly in embodiments in which the alignment between the plug part and the socket part is not important.

Preferably, the plurality of projections of the accessory may extend from the plug part. Alternatively, the plurality of projections may extend from the socket part.

Preferably, the plug part and the socket part may engage with one another such that a portion of a component, such as padding or a protective bib, may be trapped between the plug part and the socket part. In this way, the component may be held in place between the plug part and the socket part. For example, the component may be held in place due to a clamping force between the plug part and the socket part.

Additionally or alternatively, the component may include an aperture in which a portion of the plug part is receivable. For example, the rod of the plug part may be receivable in an aperture of the component. Preferably, the aperture may be a similar size to the rod of the plug part.

In this way, the component may be held in place due to a mechanical engagement with the plug part.

Therefore, the two-part construction of the main body may form an attachment means that facilitates attachment of a component to the fencing mask.

Preferably, the plug part and the socket part may be engageable such that a gap is formed between a surface of the plug part and a surface of the socket part. The gap may be advantageous to accommodate thicker components.

However, it is envisioned that it may also be advantageous in some embodiments to not provide such a gap, for example to increase the clamping force on the component, or when the accessory is to be used with a component having at least one aperture.

Further preferably, the two parts of the main body may be removably engageable with one another. As such, the plug part and the socket part may be removably engageable with one another.

For example, the plug part and the socket part may be cooperatively shaped to provide a mechanical engagement that allows the plug part and the socket part to be separated from one another. Alternatively, a frictional force between the plug part and the socket part may removably secure the plug part and the socket part to one another.

A removable engagement may be advantageous to provide further flexibility in the use of the accessory. For example, the removable engagement of the two-part construction may allow different components to be interchangeably attached to the same accessory.

Alternatively, the two parts of the main body may be permanently engageable with one another. As such the plug part and the socket part may be permanently engageable with one another. For example, once a component has been held between the plug part and the socket part, glue may be used to provide a permanent engagement between the plug part and the socket part.

Alternatively, heat may be applied to melt part of the accessory, so that a permanent engagement is provided between the plug part and the socket part. For example, in the above-described embodiment where a rod of the plug part is inserted into an aperture in the socket part, the rod may be melted to provide an engagement with the socket part.

In this arrangement a portion of the rod could be formed of a different material to the rest of the accessory, to allow the end portion of the rod to melt at a suitable temperature, when heat is applied to the accessory. Alternatively, the rod could be formed of the same material as the rest of the accessory, and heat could be applied locally to melt the end of the rod.

A permanent engagement may be advantageous to provide a more secure attachment of components such as padding or a protective bib to the accessory.

Preferably, the socket part may be annular, and may include a central aperture in which a portion of the plug part is receivable.

With that said it is envisioned that the two-part construction could be achieved in any suitable manner. For example, the main body could comprise two parts that are magnetically attracted to one another. In this way, a component such as padding or a protective bib could be inserted between the two parts, and the magnetic attraction between the two parts could secure the component to the accessory.

It is also envisioned that the two-part construction could be provided with both mechanical and magnet based engagement. For example, the plug part and the socket part of a two-part construction could be magnetically attracted to one another.

Preferably, the accessory may be a light and the main body may comprise at least one means for emitting light. For example, the main body may comprise an LED strip.

The accessory may be a light that is used to indicate to spectators when hits have been scored. It is desirable that lights are attachable to a fencing mask by way of the present invention, as the removable nature of the accessory allows the light to be repositioned, removed and replaced, depending on the requirements of each competition.

Further preferably, the means for emitting light may be provided on a second surface of the main body. The second surface may be opposite the first surface, such that the means for emitting light faces away from the mesh when the accessory is attached to the fencing mask.

In embodiments of the present invention where the main body has the two-part construction described above, the means for emitting light may be provided on one of the two parts. In this way, the two-part construction of the accessory may allow different lights to be interchangeably attached to the fencing mask. In addition, the accessory may allow the light to be replaced, without requiring replacement of the other part of the main body.

Preferably, the socket part may comprise the means for emitting light. For example, the socket part may be an annular light, such as an LED. In this way, the accessory may allow the light to be replaced, without requiring replacement of the plug part.

Alternatively, the accessory may be padding and the main body may comprise at least one padded member. For example, the accessory may be face padding or forehead padding for a fencing mask.

Preferably, the padded member may be provided on a second surface of the main body. Further preferably, the second surface may be opposite the first surface, such that the padding faces away from the mesh when the accessory is attached to the fencing mask.

It is beneficial that padding is attachable to a fencing mask by way of the present invention, as the removable nature of the accessory allows the padding to be repositioned, removed and replaced, depending on the needs of the user.

For example, the user may wish change the type of padding used, depending on temperature or level of support required. The removability of the padding may also assist with the cleaning of the fencing mask and the accessory.

Alternatively, children may wish to attach thicker padding to the fencing mask, and then replace it with thinner padding as their head grows. Since the padding can be replaced without damage to the fencing mask, this provides a safer and longer lasting fencing mask.

The removable padding according to the present invention may also allow different users to use the same fencing mask, since different padding may be attached to suit the needs of each user.

Due to the manner in which the accessory of the present invention uses the existing apertures of a fencing mask, the disclosed invention allows the padding to be repositioned, removed and replaced, without damage to the fencing mask.

The present invention also allows the padding to be repositioned at various points on the fencing mask, to best suit the user's head shape.

Alternatively, the accessory may be a camera and the main body may comprise at least one means for capturing images and/or videos.

Alternatively, the accessory may be a protective bib. The protective bib may be provided with a plurality of projections that are each configured to be removably insertable into an aperture of the mesh, such that the bib extends beyond the bottom of the fencing mask when the mask is in use.

The present invention also provides a fencing mask comprising at least one removable accessory as described above in certain embodiments.

The present invention also provides a method of removably attaching an accessory to a fencing mask provided with a mesh having an array of apertures in certain embodiments.

The method can comprise in certain embodiments providing an accessory comprising a main body having a first surface and a plurality of projections extending from the first surface of the main body; aligning each projection with an aperture of the mesh of the fencing mask; and inserting each projection into an aperture of the mesh.

Preferably, the accessory may be in accordance with the removable accessory described above.

BRIEF DESCRIPTION OF THE DRAWINGS

The present invention will now be described with reference to the embodiments shown in the drawings, wherein.

DETAILED DESCRIPTION OF THE PREFERRED EMBODIMENTS

In one aspect, the present invention provides a removable accessory for a fencing mask provided with a mesh having an array of apertures. A first preferred embodiment of the accessory 1 is shown in FIGS. 1 to 6.

FIGS. 1 to 4 show the accessory 1 on its own.

Figure 5:
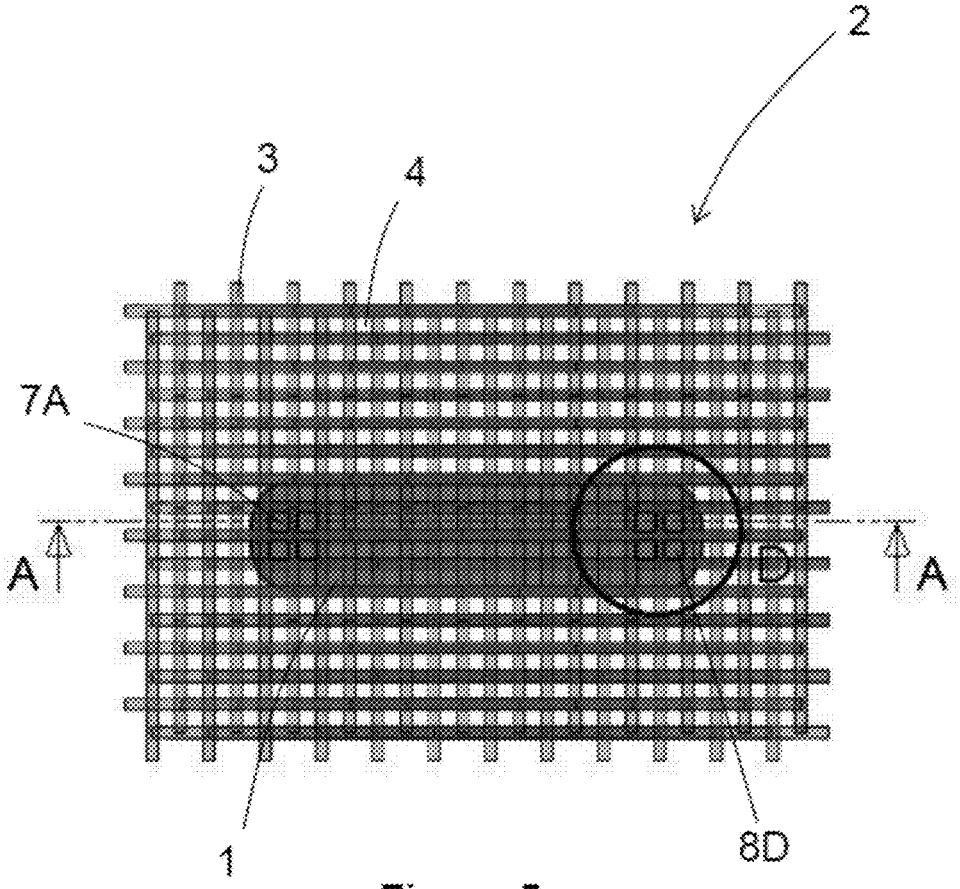
FIG. 5 shows the accessory shown in FIG. 1 in use attached to a mesh.
Figure 6:
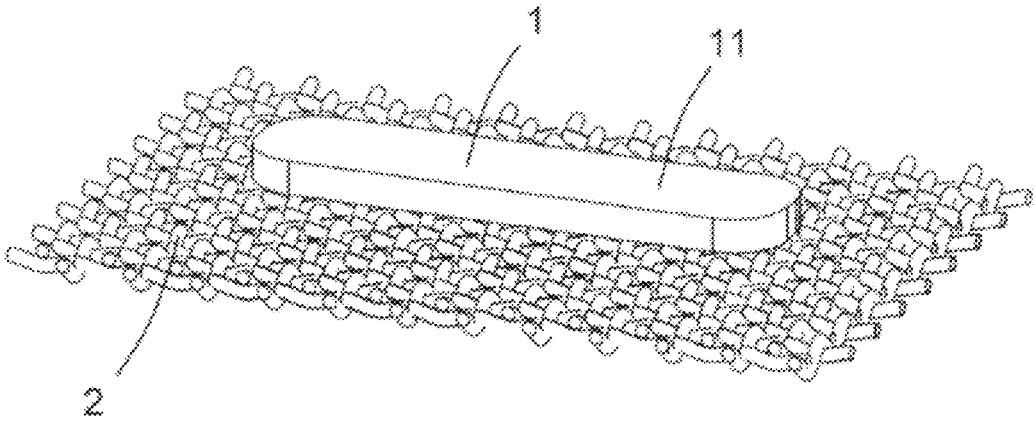
FIG. 6 shows a perspective view of the accessory shown in FIG. 5 in use attached to a mesh.

FIGS. 5 and 6 show the accessory 1 according to the first embodiment of the invention, attached to a mesh 2 of a fencing mask. For the sake of clarity, only a portion of the mesh is shown.

As shown in FIG. 5, the mesh 2 is an array of woven wires 3 that defines a plurality of apertures 4. The array of apertures 4 is formed from the spaces between the woven wires 3.

However, it is envisioned that alternative mesh constructions are possible. It will be appreciated that any mesh that comprises an array of apertures, like those formed from woven wires, would be compatible with the accessory of the present invention.

Figure 5A:
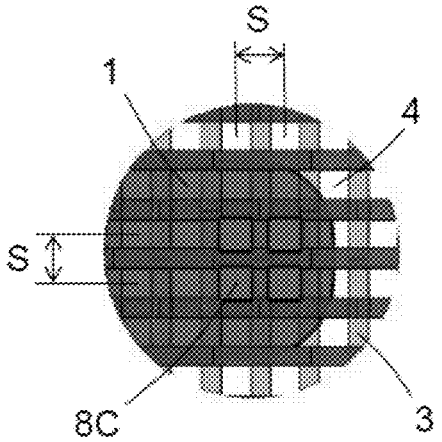
FIG. 5A shows an enlarged version of detail D of FIG. 5.

The aperture spacing S of the mesh 2, as shown in FIG. 5A, is the distance between centres of adjacent apertures 4 of the mesh 2.

The protective face masks used in fencing are typically made from mesh having a standardised wire diameter and aperture size. Therefore, the aperture spacing S is standardised for the mesh of fencing masks.

As shown in FIGS. 1 to 4, in a first preferred embodiment the accessory 1 comprises a main body 5 having a first surface 6, and eight projections 7A, 7B, 7C, 7D, 8A, 8B, 8C, 8D extending from the first surface 6 of the main body 5.

Each projection is configured to be removably insertable into an aperture 4 of the mesh 2. Therefore, the projections enable the accessory 1 to be removably attached to the mesh 2 of a fencing mask, without damaging the fencing mask and without the need for additional attachment means.

Figure 1:
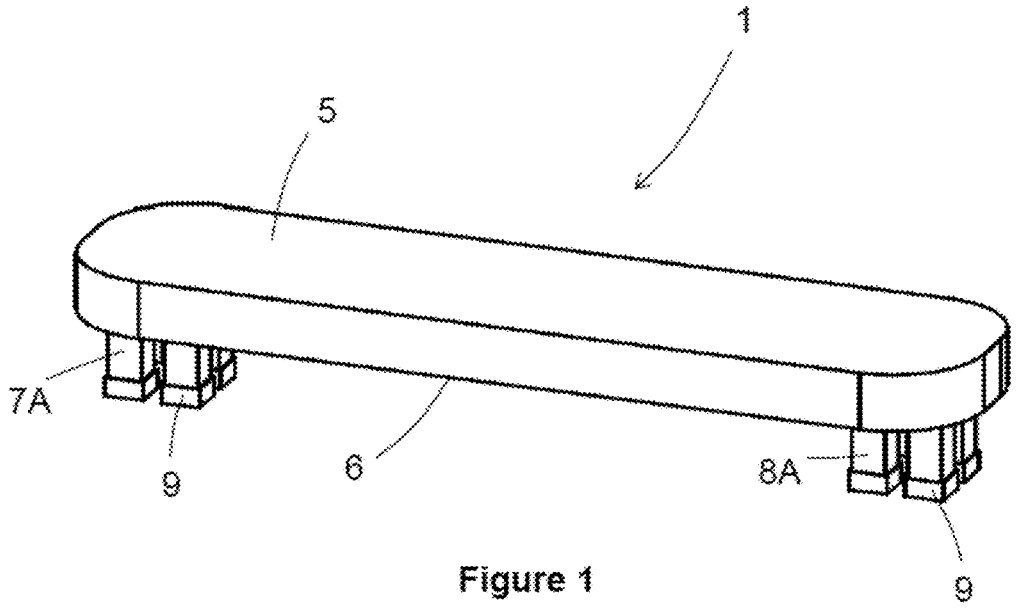
FIG. 1 shows a perspective view of an accessory for a fencing mask according to a first embodiment of the present invention.
Figure 2:
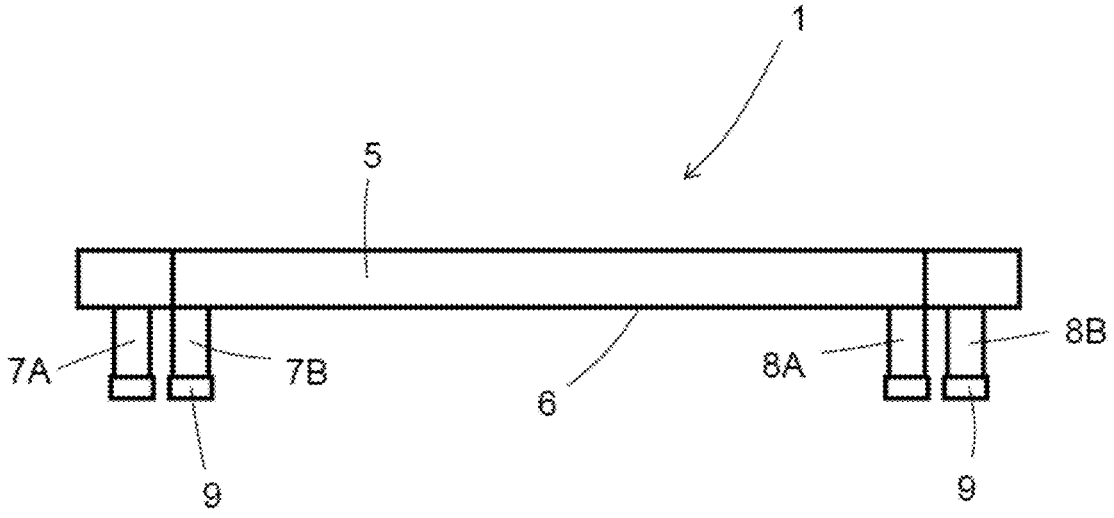
FIG. 2 shows a side view of the accessory shown in FIG. 1.
Figure 3:
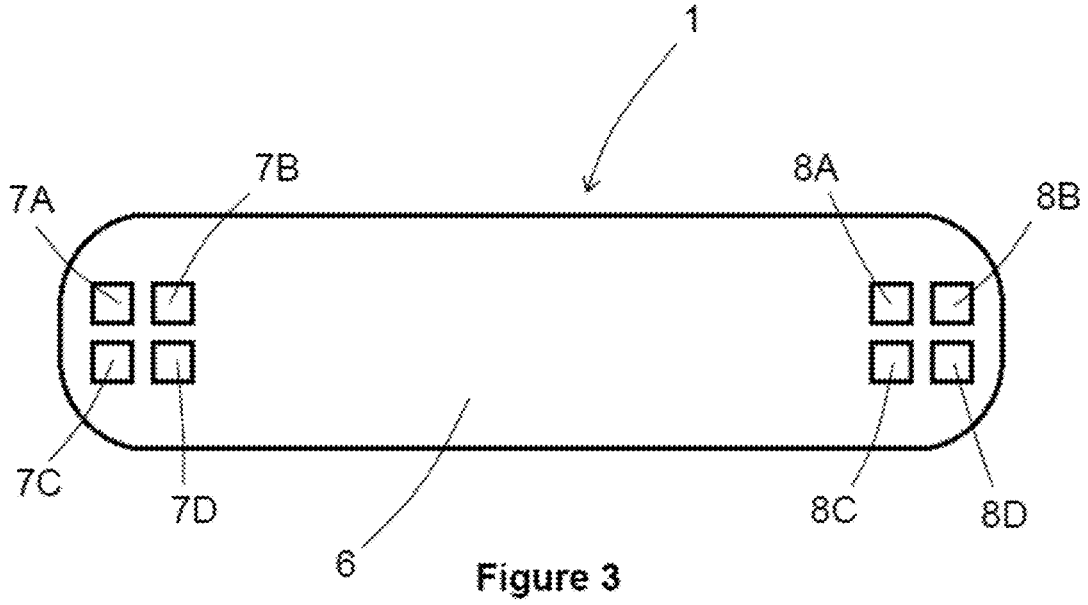
FIG. 3 shows a bottom view of the accessory shown in FIG. 1.
Figure 4:
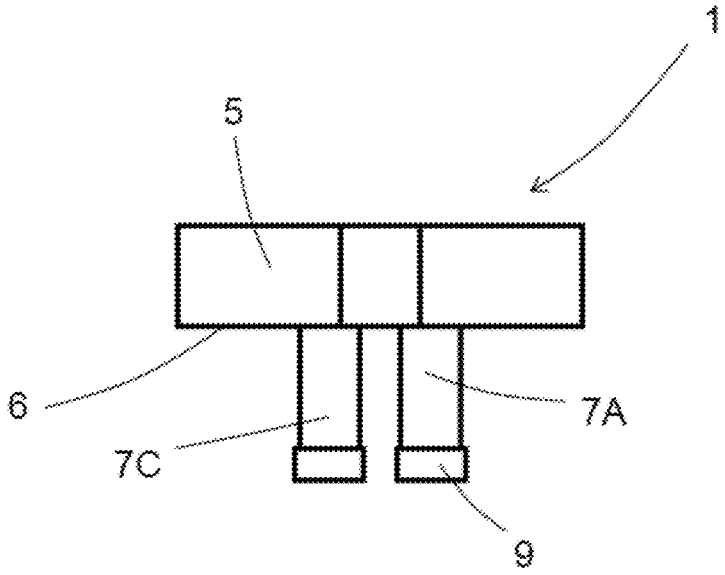
FIG. 4 shows an end view of the accessory shown in FIG. 1.

As shown in FIGS. 1 to 3, the projections are arranged into a first group 7A, 7B, 7C, 7D and a second group 8A, 8B, 8C, 8D, wherein each group comprises four projections.

However, it is envisioned that the accessory could comprise groups or clusters of any suitable number and arrangement of projections. For example, each group could contain two projections or one projection. It is also envisioned that the projections could be arranged into only one group, or into any suitable number of groups.

The distance between each projection 7A, 7B, 7C, 7D and the corresponding projection 8A, 8B, 8C, 8D of the other group is a multiple of the aperture spacing S. For example, the distance between the first projections 7A, 8A of each group is a multiple of the aperture spacing S.

In the illustrated accessory 1, as shown in FIG. 5, the distance between each projection 7A, 7B, 7C, 7D and the corresponding projection 8A, 8B, 8C, 8D of the other group is thirteen times the aperture spacing S.

However, it will be appreciated that the distance between the projections may be any suitable multiple of the aperture spacing, depending on the size and weight of the accessory, provided that the projections align with the apertures of the mesh.

The adjacent projections 7A, 7B of the same group or cluster are configured to be insertable into adjacent apertures 4 of the mesh 2.

Therefore, the distance between adjacent projections 7A, 7B of the same group is equal to the aperture spacing S.

However, it is appreciated that the distance between the projections does not need to be a multiple of the aperture spacing or equal to the aperture spacing, for example if the projections are configured to be insertable into apertures in a different row and column of the mesh. Essentially, any projection spacing is envisaged provided that the inter-projection spacing facilitates the insertion of the projections into different apertures of the mesh.

Each of the projections 7A, 7B, 7C, 7D, 8A, 8B, 8C, 8D comprises a tip 9 at the distal end thereof, wherein the tip 9 has a larger cross-section than the rest of the projection.

Figure 5B:
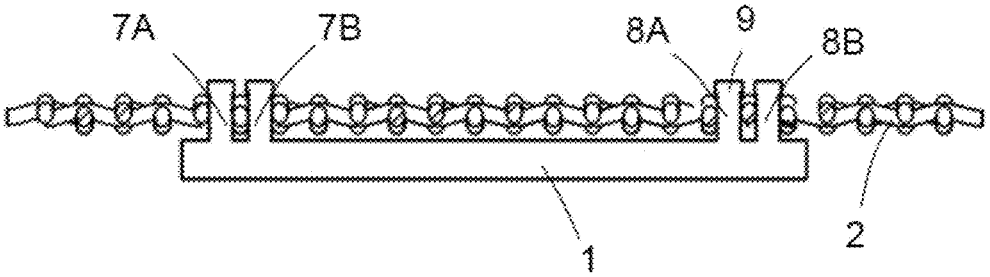
FIG. 5B shows a cross-section of the accessory and mesh shown in FIG. 5, along the line A-A.

As shown in FIG. 5B, the cross-section of the tip 9 is greater than the size of the aperture 4. Also, the length of each projection is greater than the diameter of each wire 3 of the mesh 2. Therefore, each projection extends beyond the surface of the mesh 2. In this way, the tip 9 helps to secure the accessory 1 to the fencing mask, as the large tip 9 restricts the projection from passing back through the aperture.

However, it will be appreciated that the projections do not need to be long enough to extend beyond the wires of the mesh. In this regard, it is sufficient that the projections extend to the pinch point, i.e. the smallest size, of each aperture.

The tip 9 is manufactured from a compressible material, such that the tip 9 is configured to be compressible when inserted into the aperture 4.

However, it is appreciated that the tip could instead comprise a rigid material, and the compressibility of the tip could be achieved by other means, for example by providing the tips with slots and/or internal voids.

It is also envisioned that the tip may not need to have a larger cross-section than the rest of the projection, for example if the entire projection was configured to be compressible, or if the tip is configured to mechanically engage with the wires of the mesh.

In the preferred embodiment, the projections 7A, 7B, 7C, 7D, 8A, 8B, 8C, 8D extend parallel to one another, and are oriented perpendicular to the first surface 6.

However, it is envisioned that one or more of the projections could extend from the first surface at an angle offset from the perpendicular. The offset angle could help to secure the projections in the mesh, particularly if the projections do not comprise a tip that is greater in cross-section than the size of the aperture.

The main body 5 of the accessory is flat and rounded rectangular. However, it is envisioned that the main body could be any suitable shape, for example rectangular or elliptical, depending on the function of the accessory.

No attachment means is shown on the accessory of the first embodiment. However, it will be understood that the attachment means would be provided on a second surface 11 of the accessory, such that the attachment means is furthest from the mesh when the accessory is attached to a fencing mask.

The attachment means employed on the first embodiment could be in the form of one portion of a hook and loop fastener, wherein the corresponding portion would be provided on the component (e.g. light) that is to be received on the accessory.

Alternatively, it is envisioned that the accessory could comprise a component such as a light, padding or a camera. The component would be provided on a second surface of the accessory, such that the component is furthest from the mesh when the accessory is attached to a fencing mask.

Figure 7:
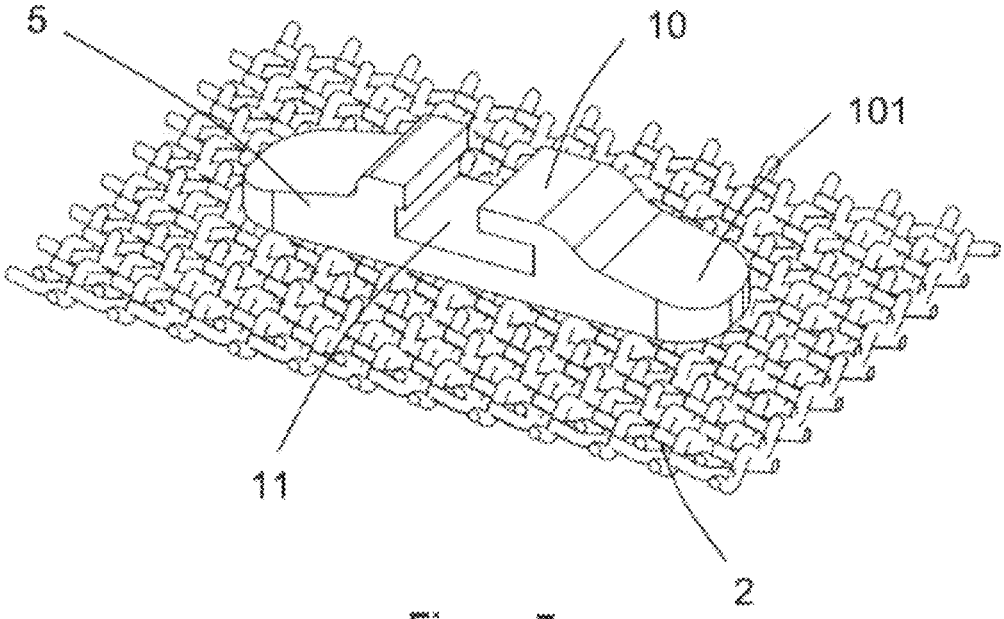
FIG. 7 shows a perspective view of an accessory for a fencing mask according to a second embodiment of the present invention in use attached to a mesh.

FIG. 7 shows an accessory 101 according to a second preferred embodiment of the present invention, wherein an attachment means 10 is provided on a second surface 11 of the main body 5.

The second surface 11 is opposite the first surface 6, such that the attachment means 10 faces away from the mesh 2 when the accessory is attached to the fencing mask, as shown in FIG. 7.

The attachment means 10 may be used to attach any suitable component to the fencing mask. For example, the attachment means may be used to attach a light, padding, a camera, or a protective bib to the fencing mask.

The illustrated attachment means is a clip, to which a component such as an LED strip may be attached.

However, it is envisioned that the main body could comprise any suitable attachment means, for example one portion of a hook and loop fastener.

Additionally or alternatively, the main body could comprise a component such as a light, a padded member or a camera.

FIGS. 8A to 10C show an accessory 201 according to a third preferred embodiment of the present invention, in which the main body 205 has a two-part construction.

The main body 205 comprises a plug part 202 and a corresponding socket part 203. The plug part 202 comprises a rod 206, which is receivable in a corresponding aperture 207 in the socket part 203. In this way, the plug part 202 and the socket part 203 are cooperatively shaped, such that they are engageable with one another.

Figure 10A:
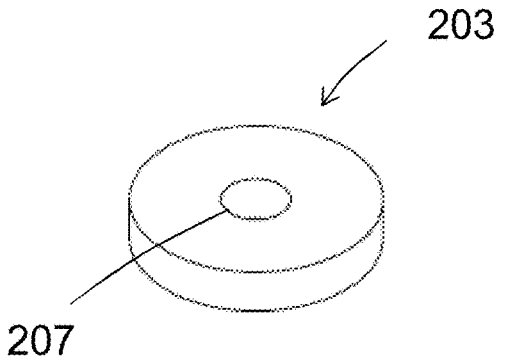
FIG. 10A shows a perspective view of the socket part of the accessory shown in FIG. 8A.
Figure 10B:
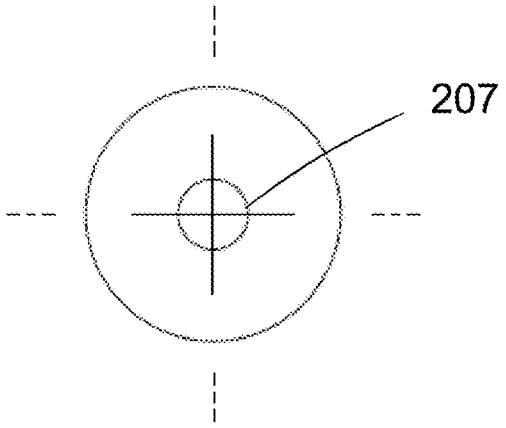
FIG. 10B shows a top view of the socket part shown in FIG. 10A.
Figure 10C:
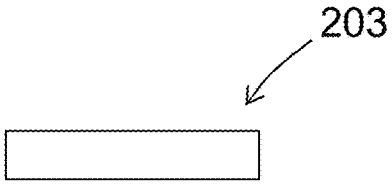
FIG. 10C shows a side view of the socket part shown in FIG. 10A.

FIGS. 9A to 9F show various views of the plug part 202, and FIGS. 10A to 100 show various views of the socket part 203. FIGS. 8A to 8F show the plug part 203 and the socket part 203 engaged with one another, with the rod 206 of the plug part 202 received in the aperture 207 in the socket part 203.

Figure 8A:
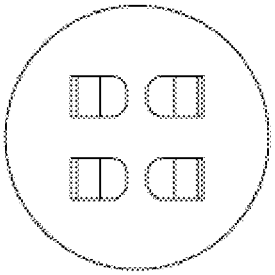
FIG. 8A shows a bottom view of an accessory for a fencing mask according to a third embodiment of the present invention, wherein the main body comprises a plug part and a socket part.
Figure 8B:
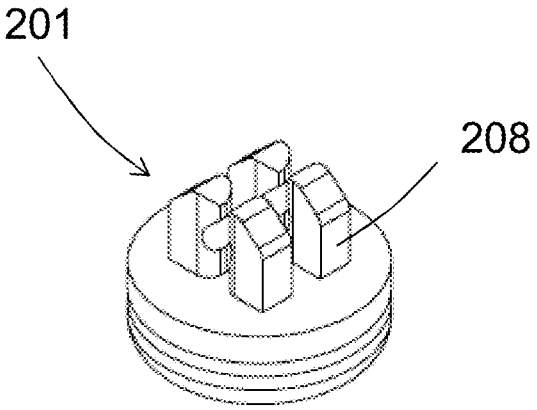
FIG. 8B shows a perspective view of the accessory shown in FIG. 8A.
Figure 8C:
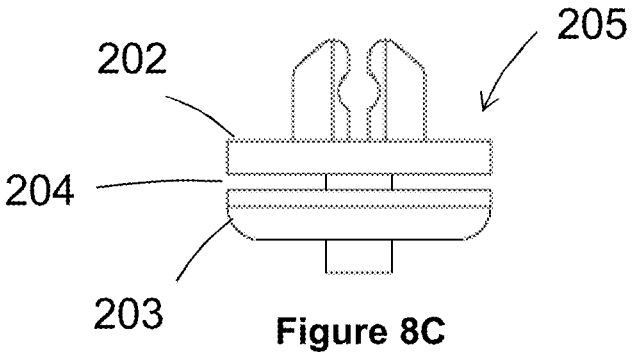
FIG. 8C shows a front view of the accessory shown in FIG. 8A.
Figure 8D:
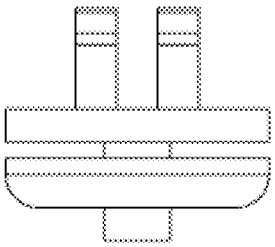
FIG. 8D shows a side view of the accessory shown in FIG. 8A.
Figure 8E:
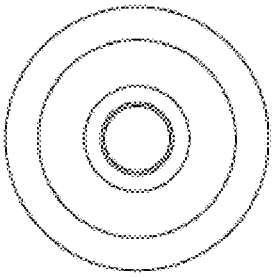
FIG. 8E shows a top view of the accessory shown in FIG. 8A.
Figure 8F:
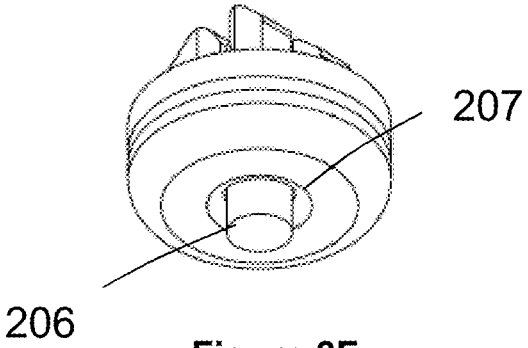
FIG. 8F shows a perspective view of the accessory shown in FIG. 8A.
Figure 9A:
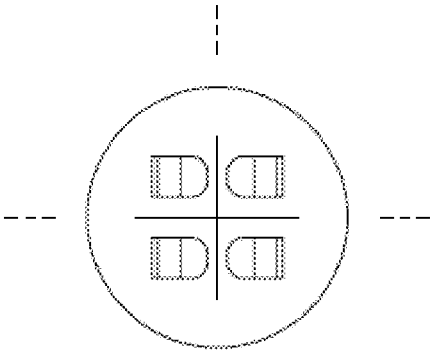
FIG. 9A shows a bottom view of the plug part of the accessory shown in FIG. 8A.
Figure 9B:
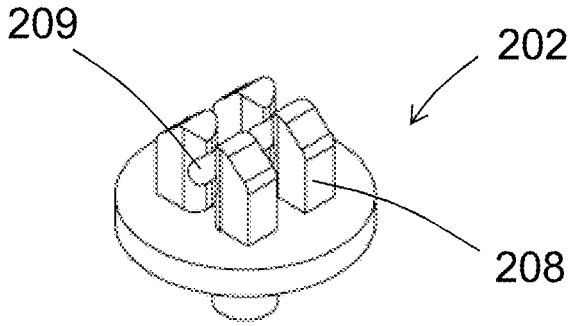
FIG. 9B shows a perspective view of the plug part shown in FIG. 9A.
Figure 9C:
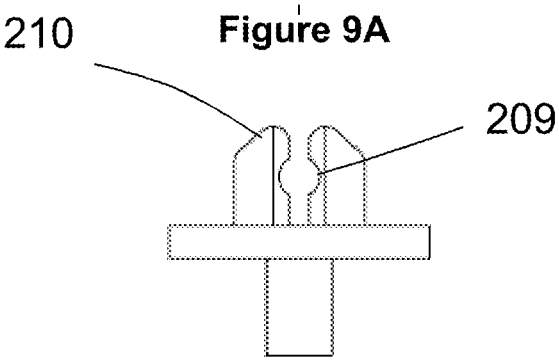
FIG. 9C shows a front view of the plug part shown in FIG. 9A.
Figure 9D:
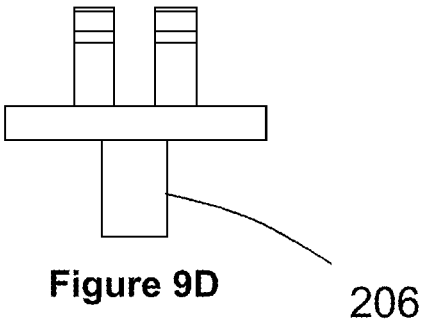
FIG. 9D shows a side view of the plug part shown in FIG. 9A.
Figure 9E:
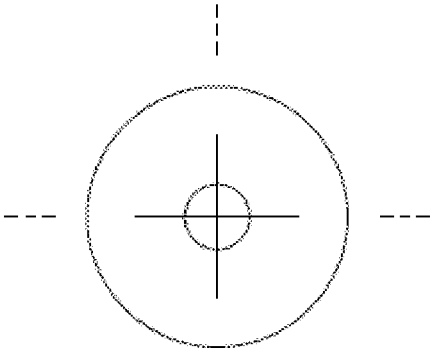
FIG. 9E shows a top view of the plug part shown in FIG. 9A.
Figure 9F:
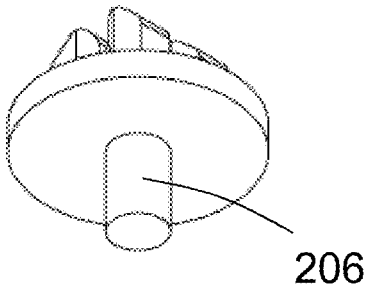
FIG. 9F shows a perspective view of the plug part shown in FIG. 9A.

As shown in FIGS. 8C and 8D, when the plug part 202 and the socket part 203 are engaged with one another, a gap 204 is formed between a surface of the plug part 202 and a surface of the socket part 203. In use, this gap 204 receives a portion of a component, such as padding or a protective bib. In this way, the component is held in place between the plug part 202 and the socket part 203.

Depending on the component to be secured to the fencing mask, the component may be held in place by a clamping force between the plug part 202 and the socket part 203. Additionally or alternatively, the component may include an aperture in which a portion of the rod 206 of the plug part 202 is receivable.

Therefore, the two-part construction of the main body 205 forms an attachment means that facilitates attachment of a component to the accessory and the fencing mask.

The socket part 203 is annular, and includes a central aperture 207 in which the rod 206 of the plug part 202 is receivable.

After a component has been held between the plug part 202 and the socket part 203, glue may be applied to permanently engage the plug part 202 and the socket part 203 with one another. However, it is also envisioned that the plug part and the socket part could be removably engageable with one another.

It is envisioned that the main body could instead comprise a different two-part construction. For example, the socket part could be a light, such as an annular LED. Alternatively, the main body could comprise two parts that are magnetically attachable one another. In this way, a component such as padding or a protective bib could be inserted between the two parts, and the magnetic attraction between the two parts could secure the component to the accessory.

The illustrated accessory comprises four projections 208, which extend from the plug part 202. As shown in FIGS. 8B, 8C, 9B and 9C, the projections 208 are shaped to complement the shape of the wire of the fencing mask. In particular, the projections include a cylindrical recessed portion 209, which is shaped to complement the wire.

The four projections 208 are arranged into two pairs, wherein each pair is configured to be insertable into adjacent apertures of the mesh. That is, the distance between the two projections in each pair is equal to the aperture spacing.

Therefore, when the accessory 201 is attached to the fencing mask, the recessed portions 209 of each pair of projections 208 contact either side of a single wire of the mesh.

The distal end 210 of each projection 208 is angled, to facilitate easy insertion of the projections 208 in the apertures of the mesh.

However, it is envisioned that the projections of this embodiment could have any suitable shape. For example, the two-part accessory shown in FIGS. 8A to 10C could be provided with projections having the larger tip shown in FIG. 1. It is also envisioned that the accessory could comprise any suitable number and arrangement of projections. The distance between the projections may be any suitable multiple of the aperture spacing, depending on the size and weight of the accessory, provided that the projections align with the apertures of the mesh.

The main body may be flexible, such that the accessory may accommodate the curvature of the fencing mask. For example, the main body of the accessory may be made from rubber, for example hard PVC, or plastics, for example nylon, nylon 66 or Delrin.

The tip of the projection may be manufactured from the same material as the rest of the projection. Alternatively, the tip may be manufactured from a compressible material.

The invention claimed is:

1. A removable accessory for a fencing mask provided with a woven wire mesh having an array of apertures, the accessory comprising:

a main body having a first surface; and a plurality of projections extending from the first surface of the main body, each projection being configured to be removably insertable into an aperture of the mesh; and wherein the projections are arranged into one or more clusters and each cluster comprises two or more projections that are configured to be insertable into adjacent apertures of the mesh;

wherein at least one of the projections comprises a tip at the distal end thereof, wherein the tip has a larger cross-section than the rest of the projection.

2. The accessory of claim 1, wherein at least one of the projections extends perpendicular to the first surface.

3. The accessory of claim 1, wherein at least one of the projections extends from the first surface at an angle offset from the perpendicular.

4. The accessory of claim 1, wherein at least two projections extend substantially parallel to one another.

5. The accessory of claim 1, wherein the cross-section of the tip is greater than or equal to the size of the aperture.

6. The accessory of claim 1, wherein the tip is configured to be compressible when inserted into the aperture.

7. The accessory of claim 1, wherein at least one of the projections comprises a recessed portion, which is shaped to complement the shape of a wire of the mesh.

8. The accessory of claim 1, wherein at least one attachment means is provided on a second surface of the main body.

9. The accessory of claim 1, wherein the accessory is a light and the main body comprises at least one means for emitting light.

10. The accessory of claim 1, wherein the accessory is padding and the main body comprises at least one padded member.

11. The accessory of claim 1, wherein the main body has a two-part construction, wherein preferably the main body comprises a plug part and a corresponding socket part that is engageable with the plug part.

12. The accessory of claim 11, wherein one part of the two-part construction of the main body comprises the at least one means for emitting light.

13. The accessory of claim 11, wherein the two-part construction provides an attachment means for attaching at least one padded member to the accessory.

14. A fencing mask comprising at least one removable accessory according to claim 1.

15. A method of removably attaching an accessory to a fencing mask provided with a woven wire mesh having an array of apertures, the method comprising:

providing an accessory comprising a main body having a first surface and a plurality of projections extending from the first surface of the main body, wherein at least one of the protections comprises a tip at the distal end thereof, wherein the tip has a larger cross-section than the rest of the projection, and wherein the projections are arranged into one or more clusters and each cluster comprises two or more projections that are configured to be insertable into adjacent apertures of the mesh;

aligning each projection with an aperture of the mesh of the fencing mask; and inserting each projection into an aperture of the mesh.

16. The method of claim 15, wherein the accessory is in accordance with claim 1.

* * * * *